US007442096B1

(12) United States Patent
Gilliam

(10) Patent No.: US 7,442,096 B1
(45) Date of Patent: Oct. 28, 2008

(54) MALE ELECTRICAL CONNECTOR

(75) Inventor: Charles David Gilliam, Baton Rouge, LA (US)

(73) Assignee: Rig Power, LLC, Baton Rouge, LA (US)

( * ) Notice: Subject to any disclaimer, the term of this patent is extended or adjusted under 35 U.S.C. 154(b) by 0 days.

(21) Appl. No.: 12/015,661

(22) Filed: Jan. 17, 2008

(51) Int. Cl.
*H01R 13/05* (2006.01)

(52) U.S. Cl. ..... 439/825; 439/149

(58) Field of Classification Search ..... 439/825, 439/884, 889, 149, 148
See application file for complete search history.

(56) References Cited

U.S. PATENT DOCUMENTS 2,851,670 A * 9/1958 Senior ..... 439/825
2,907,973 A * 10/1959 Stevens, Jr. ..... 439/282
3,109,690 A 11/1963 Stevens, Jr.
3,131,478 A 5/1964 Snurr
3,226,667 A * 12/1965 Senior, Jr. ..... 439/282
3,644,869 A 2/1972 Newman
3,662,296 A 5/1972 Newman
4,473,714 A 9/1984 Brownell
5,316,502 A 5/1994 Loet
5,427,538 A 6/1995 Knapp
5,486,123 A * 1/1996 Miyazaki ..... 439/825
5,893,782 A 4/1999 Harting

* cited by examiner

*Primary Examiner*—Neil Abrams
*Assistant Examiner*—Phuong Nguyen
(74) *Attorney, Agent, or Firm*—Roy, Kiesel, et al

(57) ABSTRACT

An improved single-pole, male, electrical connector for use in industrial applications involving very high currents (e.g., in excess of 1,000 amps) and a method for making and adjusting the connector are disclosed. The connector has a male pin with a slot along most of its length and an adjustment mechanism that is used to vary the width of the slot. By varying the width of the slot, the effective diameter of the pin is changed. The male connector must fit tightly in a female connector, and the adjustment is used to obtain the required fit. In the disclosed invention, the adjustment mechanism is positioned near a tip of the pin and under an insulating safety cap. The adjustment mechanism is configured for adjustment prior to installation of the safety cap.

14 Claims, 3 Drawing Sheets

MALE ELECTRICAL CONNECTOR

FIELD OF THE INVENTION

The invention relates to single-pole electrical connectors, and in particular to an improved male, single-pole electrical connector for high-current, industrial applications, such as oil field drilling rigs.

BACKGROUND AND SUMMARY OF THE INVENTION

Oil and gas drilling rigs are located throughout the world, both on land and at sea. There are important differences between the types of drilling rigs used for inland sites compared to those used for offshore drilling. An offshore drilling rig is typically very large, and may be made as a unitary structure. The electrical power generation and distribution system can be built on an offshore rig before the rig is moved into its operating location. This allows for hardwired connections and other permanent or semi-permanent electrical connections in the electrical distribution system.

Many inland oil and gas drilling rigs are much smaller than their offshore counterparts. It is common for inland rigs to be constructed in a more modular form, with the various parts of the rig being put together at the drilling location. A rig of this type may be hauled to the drilling site on one or more trucks. Because the rig is delivered in parts and assembled on site, the electrical distribution system is often prepared on site, as well. It is not common to have an electrical power distribution system pre-wired for a smaller inland drilling rig.

The field assembly and installation of many inland drilling rigs has led to widespread use of single pole electrical connectors that can be prepared in the field. These connectors take different forms, including pin and collet style connectors or plug and receptacle style connectors. The latter require very tight fits between the plug and the receptacle to ensure minimal resistance to the high current loads and to prevent the connections from pulling apart during use. Different types of locking mechanisms are also typically used with plug and receptacle connectors to ensure the connections do not inadvertently pull apart. There remains, however, a need to ensure a very tight fit between the plug and receptacle.

To achieve the needed fit, a split-pin design has been used in oilfield applications for many years. In this design, the male pin connector, which could be part of either the plug or receptacle, has a conductive pin that is cut into two halves by a slot cut along the length of the pin. This slot allows the two halves of the pin to be pushed together, thus reducing the diameter of the pin, or pried apart, thus increasing the diameter of the pin. The pin's diameter is variable, and can be adjusted to provide a needed tight fit between the male and female components of a plug and receptacle type connection.

The basic variable diameter pin design is disclosed in a number of patents, including, for example, U.S. Pat. Nos. 3,644,869 and 3,662,296. The disclosures of these two patents are hereby incorporated by reference. Each of these references disclose a conductive pin having a slot cut along its length. The '869 reference discloses use of a Belleville washer positioned within the slot.

The Belleville washer or spring is well-known in the art as a means of providing a pre-selected stress within a small slot or groove. In the '869 reference, the Belleville washer positioned within the slot allows for small adjustments to the diameter of the conductive pin. The disclosed configuration includes a fixing stud, which is driven into the pin and exerts a force against the Belleville washer. By increasing this force, the two sides of the pin may be separated slightly, resulting in a slight increase in the diameter of the pin. The male pin and female receiver of this type of connection are machined for a very tight fit, so only small adjustments to the diameter of the pin should be needed to ensure the necessary fit is obtained.

This basic type of variable-diameter pin design has been in use in oilfield applications for many years. The tip end of the pin is often covered by a protective, insulating safety cap, which helps protect workers from inadvertently contacting a live connector. The insulating safety cap is typically just more than one-half inch long, and covers about 20-25% of the length of the conductive pin. A safety cap of this type is widely used, and is discussed in the '296 reference identified above and incorporated into this application.

The Belleville washer adjustment mechanism in the prior art male connector is positioned about one inch from the tip end of the pin. A port is typically drilled or cut into one side of the pin about one inch for the tip of the pin. This port is typically threaded. The Belleville washer or washers are positioned with their center aligned with the threaded port. An adjustment screw is screwed into the threaded port until it exerts pressure on the Belleville washer.

The pin is then checked for fit with a female receiver. If the male pin fits too loosely, the adjustment screw is tightened, which exerts more force on the Belleville washer, and thus causes the two halves of the split pin to separate slightly. The fit is then checked again. This process is repeated until the desired fit is achieved.

These adjustments and tests are done prior to use of the connectors in the field. This design does allow for field-adjustment of the variable-diameter pin, but that option is often undesirable. The fit tolerances of these components are so tight that even small temperature differences between male and female will result in an improper fit. Field operators often lack the experience or expertise needed to make the fine adjustments required for these types of connections. Though a field-adjustable pin may seem advantageous at first blush, it is, in fact, a undesirable condition. Field adjustment of these components is likely to cause much more harm than good.

In the prior art design, the adjustment port is typically beveled. The allows for easy placement of the adjustment screw in the port, and facilitates the placement of a screwdriver, Allen wrench, or other tightening means into the port for adjustment.

Through the many years of use of this type of variable-diameter pin connector, a number of problems have arisen. First, the pin is field-adjustable, as explained above. This is not desirable in practice. Second, the beveled opening of the port tends to become clogged with dirt and debris in the field. The materials clogging the port may prevent the male pin and female receiver from obtaining the needed tight fit. If gritty materials clog the port, those materials may come out during assembly of the connection and score both the male pin and the female receiver.

A third problem arises from burrs left by the cutting of the bevel. If a burr is left, it is likely to cause damaging scoring of the female receiver when the connection is made up in the field. A forth problem arises from the drilling of the port, the tightening of the adjustment screw or both. This problem is the creation of a very small dimple on the outside of the pin as a point opposite the location of the adjustment port. The dimple is small, but given the very tight fit required for these connectors, even a small irregularity can result in a poor fit between the male pin and female receiver.

In this traditional design, the last one-half inch or so of the pin is of slightly less outer diameter to allow for placement of the insulating safety cap. When the cap is in place, the outer diameter of the cap is the same as, or, more typically, slightly less than that of the main body of the pin. A slightly reduced diameter safety cap allows for easier insertion of the male pin into the female receiver.

An improved variable-diameter pin design is needed. Though the traditional design has proved adequate, the problems identified above show that there is clearly room for improvement. These types of connectors are used in applications where current levels of hundreds of amps, and even more than one-thousand amps, are quite common. With such high amp loads, even a very small increase in the resistance of a connector can result is substantial resistive heating, which can damage insulation and other materials, thus leading to a domino effect of failures. Given the context in which these connectors are used, it is important to maintain the best possible electrical connection with the lowest possible resistance. The problems identified above tend to produce slight increases in the resistance of the connection.

The present invention addresses the problems described above. An improved, variable-diameter pin design is disclosed. The adjustment mechanism is positioned near the tip of the pin and under the safety cap. This design prevents field adjustment of the pin because the safety cap is not a field-removable item. It eliminates clogging of the adjustment screw port. It prevents burrs from scoring the female receiver because the port is covered by the safety cap, and because the port is cut into the slightly reduced diameter tip portion of the pin. Finally, any dimple created opposite the adjustment screw port is also covered by the safety cap and is located in the smaller diameter tip portion of the pin. For this reason, a small dimple created opposite the port will have no adverse effect on the performance of the connector.

These and other objects and advantages of the present invention shall become apparent from the following descriptions of the invention. In one preferred embodiment, the present invention has an electrically conductive pin having a contact region, a tip, and a slot extending along most of the contact region and to the tip, wherein the slot extends entirely through the pin whereby the pin is divided into two semi-cylindrical members; an insulating safety cap positioned over the tip of the conductive pin; and, an adjustment mechanism positioned under the insulating safety cap and configured to vary the width of the slot and thus the effective diameter of the conductive pin.

In another preferred embodiment, the present invention includes the steps of making a cylindrical, electrically conductive pin having a contact region and a tip, wherein the outside diameter of the tip is less than the outside diameter of the contact region; cutting a slot in the conductive pin extending from the tip and through most of the contact region of the pin such that the pin is divided into two semi-cylindrical members; installing an adjustment mechanism within the slot of the conductive pin and in the tip of the conductive pin; determining whether the contact region of the conductive pin has a desired outside diameter; if the contact region of the conductive pin does not have the desired outside diameter, varying the effective diameter of the conductive pin by adjusting the adjustment mechanism; repeating the prior two steps until the contact region of the conductive pin has the desired outside diameter; and, installing an insulating safety cap over the tip of the conductive pin such that the adjustment mechanism is rendered inaccessible during normal use. These and other embodiments are described in more detail below.

DETAILED DESCRIPTION OF THE PREFERRED EMBODIMENTS OF THE INVENTION

The improvements of the present invention can be further understood by considering in detail certain embodiments and aspects of the present invention. FIGS. 1-4 show mated pairs of connectors of a type commonly used in oilfield and other industrial applications. In these applications, single pole connectors capable of carrying very high current loads (e.g., 1,000 amps or more) without excessive resistive heating are widely used. One preferred configuration consists of a panel-mounted connector acting as a receptacle, and a cable-end connector acting as a plug. The panel-mount and cable-end connectors can be either male or female, as the figures and the following description show.

Figure 1:
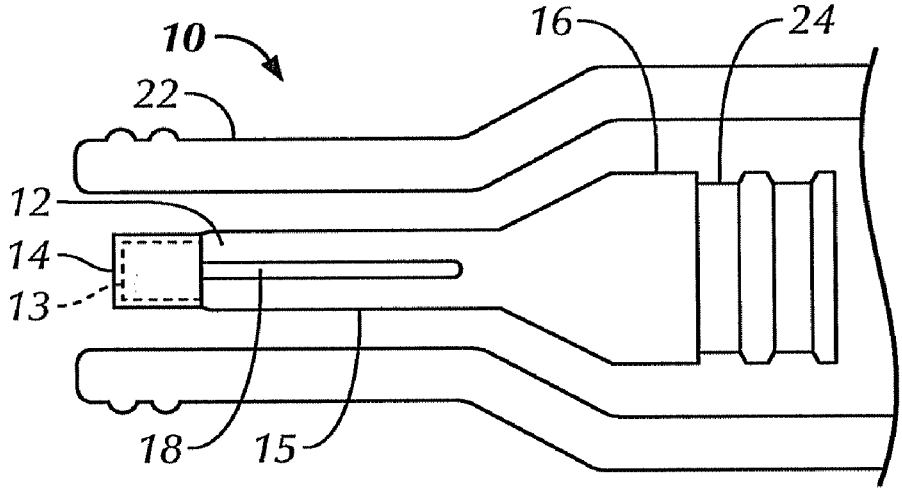
FIG. 1 is a cross-sectional view of a male plug connector.

Turning to FIG. 1, we see a single-pole, cable-end, male connector 10, which would be connected to the end of a large electrical cable in practice. The connector 10 has an electrically conductive pin 12, which is sized to fit snugly within a female connector. The tip 13 of the conductive pin 12 is covered by an insulating safety cap 14. The remainder of the conductive pin 12 constitutes a contact region 15. It is this part of the pin that makes direct electrical contact with the inside of a female connector, as will be described in more detail below. The contact region 15 typically has a slightly larger outside diameter than that of the insulating safety cap 14. This configuration allows for easier initial insertion of the male connector into the female, while ensuring that the slightly smaller diameter tip area of the conductive pin 12 is insulated to prevent arching or inadvertent contact with live contacts or connectors.

A cable contact receptacle 16 is used on the end of the connector 10 opposite the conductive pin 12. The cable contact receptacle 16 is slid over a bare end of an electrical cable, and crimping grooves 24 are then pinched down to form a secure, electrically-conductive, connection between the connector 10 and the electrical cable. An insulating sleeve 22 surrounds the connector 10 to protect it from damage and to prevent persons from touching the conductive parts of the connector. The only parts of the connector 10 that are easily accessible to users are the insulating sleeve 22 and the insulating safety cap 14. When fitted to the end of a cable in this manner, the connector 10 becomes a type of plug that can be inserted into a panel-mounted receptacle, as will be described in more detail below.

Figure 9:
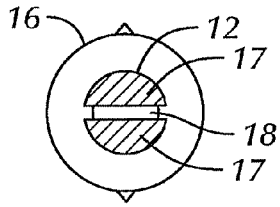
FIG. 9 is an end-view, cross-section, of a conductive pin in accordance with the present invention.

The conductive pin 12 shown in FIG. 1 includes a longitudinal slot 18 that extends along most of the contact region 15 and to the tip 13. The slot 18 extends entirely through the pin 12, as shown, and thus divides the pin 12 into two semi-cylindrical members 17. These two members 17 are approximately the same size, as the slot 18 extends approximately along a diameter of the cross-section of the pin 12, and thus divides the pin 12 approximately in half. The semi-cylindrical members 17 each have a generally semi-circular cross-section, as shown in FIG. 9. The semi-cylindrical members 17 are not perfectly semi-cylindrical because the two members 17 are each slightly less than one-half of a full cylinder. This results from the fact that the slot 18 is cut down the middle of the pin 12, and thereby eliminates a small part of the full cylinder of the pin 12.

The effective diameter of the contact region 15 may be varied by forcing apart slightly the two semi-cylindrical members 17. An adjustment mechanism 20, not shown in FIG. 1, may be used to make small adjustments to the diameter of the contact region 15. This type of connector typically requires a very snug fit between the male and female components, and use of a variable diameter conductive pin 12 ensures that the desired fit can be obtained.

Figure 2:
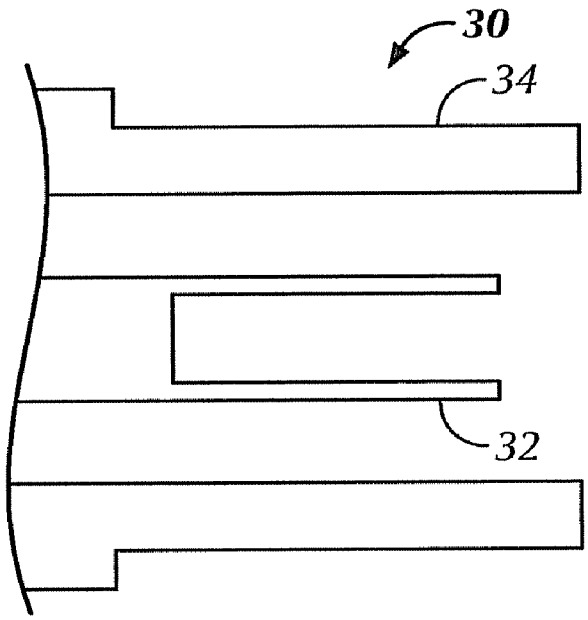
FIG. 2 is a cross-sectional view of a female panel mount connector.

FIG. 2 shows a panel-mounted female connector 30. This connector 30 has a female receiver 32 and an outer frame 34. The frame 34 is typically made of structural material, such as aluminum. It is not typically an insulating member, though an insulating sleeve or barrier could be used over the outside surface of the panel-mounted female connector 30.

In practice, once the male connector 10 has been fitted to a cable end, the connector 10 may be inserted into a panel-mounted, female connector 30. The male in this illustration is the plug and the female is the receptacle. The male connector 10 is inserted so that the conductive pin 12 enters the female receiver 32. The fit between these two components is critical and must be tight. A loose fit will increase the resistance of the connection. Even a very small increase in resistance can result in a large increase in resistive heating because of the very large currents carried through these connectors. To ensure a proper fit, the male connector 10 is adjusted to fit snugly in the female receiver 32. This adjustment is done before the connector 10 is fitted with the insulating safety cap 14, and before the connector 10 is used in the field. The adjustment is not intended to be done in the field.

When the male plug connector 10 is inserted into the female panel-mount connector 30, the conductive pin 12 fits within the female receiver 32. The male connector 10 has an insulating sleeve 22, which slides over the outside of the female receiver 32, thus providing a layer of insulation between the conductive parts of the connection and the outer frame 34. The insulating sleeve 22 is typically made of rubber and is sized to fit securely between the female receiver 32 and the outer frame 34. Additional retaining means are typically used to ensure the connection remains secure during use.

Figure 3:
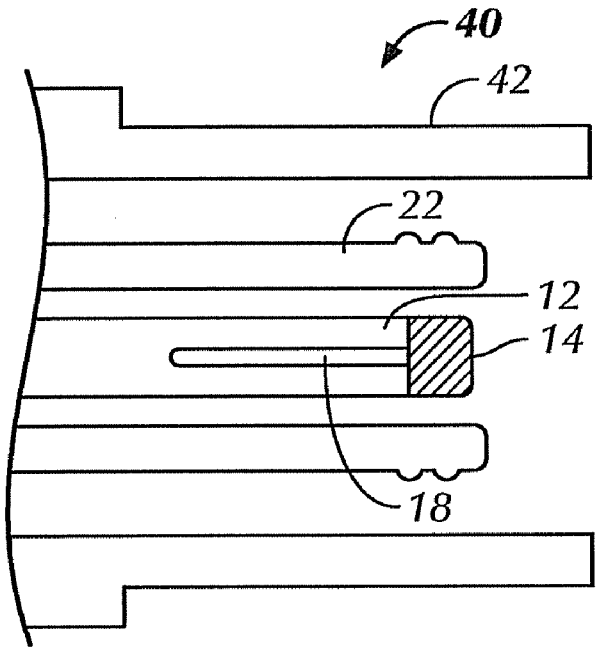
FIG. 3 is a cross-sectional view of a male panel mount connector.
Figure 4:
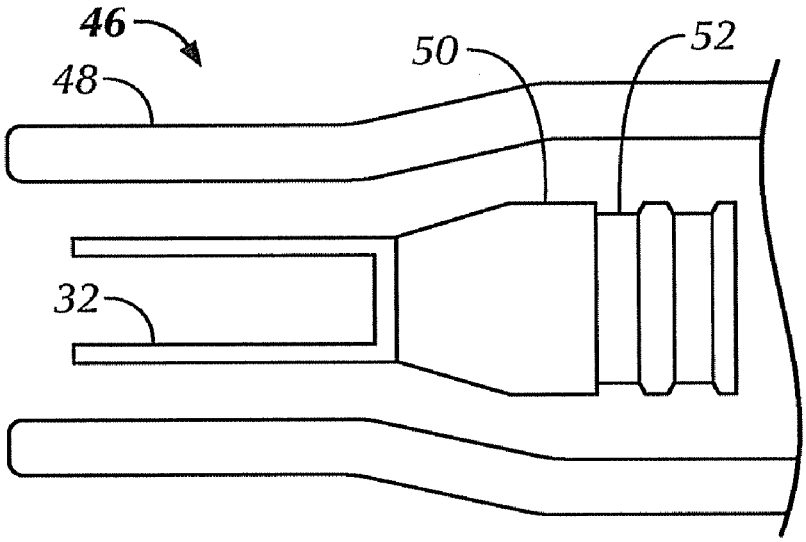
FIG. 4 is a cross-sectional view of a female plug connector.

The reverse configuration is shown in FIGS. 3 and 4, where a panel-mount male connector 40 and a cable-end female plug connector 46 are shown. The panel-mount male connector 40 has a variable diameter conductive pin 12, with an insulating safety cap 14, as described above. The pin 12 has a longitudinal slot 18 that allows for variance of the effective diameter of the pin 12. An adjustment mechanism, not shown in FIG. 3, is also used in this connector to vary the diameter of the pin 12. An insulating sleeve 22 is used, in much the same fashion as was described above. These components, which are functionally the same as those used with the cable-end male connector 10 described above, are all fitted inside a panel-mount frame 42. The entire connector 40 may then be securely mounted to an electrical panel in the field. Once mounted to such a panel, the connector 40 acts as a receptacle for a female plug connector 46, such as the one shown in FIG. 4.

The female plug connector 46 has a female receiver 32, as did the female, panel-mount connector 30 described above. The female plug connector 46, however, has an insulating sleeve 48 that surrounds the conductive parts of the connector. A cable receptacle 50 and cable crimping grooves 52 are provided so the female plug connector 46 may be securely attached to an end of an electrical cable. When installed in this manner, the connector 46 becomes a type of plug, and may be inserted into the panel-mount male receptacle connector 40.

When the female plug 46 is inserted into the panel-mount male connector 40, the female receiver 32 slides over the conductive pin 12. Again, a tight fit is required between these two components. The conductive pin 12 is adjusted, as described above, prior to use in the field to ensure the proper fit is achieved. As the female receiver 32 slides over the conductive pin 12, the insulating sleeve 22 of the male connector 40 slides over the female receiver 32. The insulating sleeve 48 of the female plug 46 slides between the insulating sleeve 22 and the panel mount frame 42.

When the connectors shown in FIGS. 3 and 4 are made up, two insulating sleeves are positioned between the conductive components and the panel mount frame 42. This arrangement is not necessary to insulate the frame 42 from the conductive parts. It is a result of the desire to provide an insulating sleeve around the male conductive pin 12 of the panel-mount male connector 40. The present invention could be constructed without such an insulating sleeve, but that arrangement would be less desirable.

Figure 5:
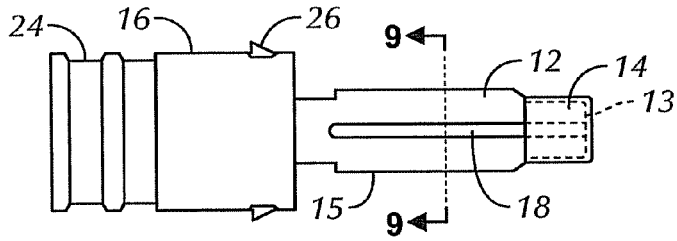
FIG. 5 is a cross-sectional view of a preferred embodiment of the present invention.

Now that the general construction and operation of connectors of this type have been described, we turn to the structure of the present invention. The invention relates to the conductive pin of the male connectors. The conductive parts of the male connector 10 are shown in FIG. 5. The conductive pin 12, tip 13, insulating safety cap 14, contact region 15, and longitudinal slot 18 are all shown. The cable contact receptacle 16 and cable crimping grooves 24 also are shown. Retaining clips 26 may be used to ensure the male connector 10 remains in place once a complete connection (i.e., both male and female connectors) has been made up.

Figure 6:
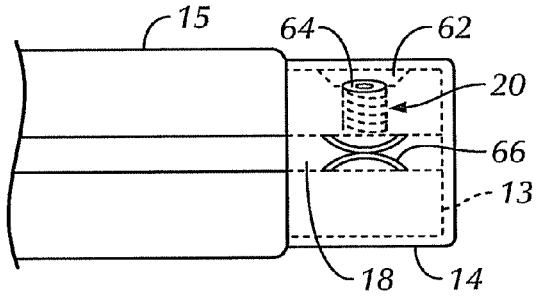
FIG. 6 is a detailed cross-sectional view of an adjustment mechanism of the present invention.
Figure 7:
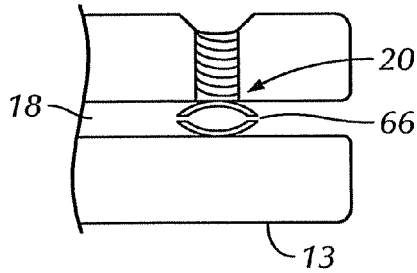
FIG. 7 is a cut-away view of an alternative embodiment of an adjustment mechanism of the present invention; and, FIG. 8 is a cross-sectional view of a portion of a prior art connector.

FIG. 6 is an enlarged side, cross-sectional view of part of the conductive pin 12. Part of the contact region 15 is shown, together with the slightly smaller diameter insulating safety cap 14, which covers the tip 13 of the conductive pin 12. The adjustment mechanism 20 is shown in this drawing. In the embodiment shown here, an adjustment port 62 has been bored into one side of the tip 13. This port 62 is threaded and receives an adjustment screw 64. A spring member 66, such as a Belleville spring, is positioned within the slot 18, and centered under the adjustment screw 64. By tightening or loosening the adjustment screw 64, the width of the slot 18 is changed, thus altering the effective diameter of the conductive pin 12. FIG. 7 is a cut-away drawing showing that the spring member 66 may be used in either a convex or concave configuration Belleville washers or another type of small leaf spring work well in this application. This type of adjustment mechanism has been widely used and its reliability is well-established. For these reasons the use of a Belleville washer or spring together with an adjustment screw are used in the preferred adjustment mechanism. The adjustment mechanism used must be small enough to fit within the slot 18, which is typically less than one-quarter inch in width. A small leaf spring inserted into the slot 18 can be forced to flatten out somewhat by the adjustment screw 64, when that screw is tightened. As the small leaf spring (e.g., such as a Belleville washer or spring 66) is flattened, it exerts more pressure on each side of the slot 18, and thereby forces the slot to widen slightly. The effective diameter of the conductive pin 12 is increased in this manner.

The adjustments accomplished are quite small, but important. As stated above, it is critical that a tight fit be achieved between the male and female components of these connectors. The tolerances are so tight that if a significant temperature difference exists between the male and female connectors, the connectors will not fit properly. For example, if one set of connectors is stored in a heated area and another is left in an unheated area on a cold night, the resulting temperature difference is likely to have an adverse impact on the fit of the connectors.

Because the tolerances are so precise, the male conductive pin 12 should fit quite securely within the female receiver 32 with little or no adjustment. But if the fit is not quite tight enough, the adjustment process described above provides sufficient variance of the diameter of the conductive pin 12 to ensure the proper fit is achieved. Thus, even though the adjustment means used provides only a small variation in the width of the slot 18, the result is sufficient to achieve the required fit.

A variety of adjustment mechanisms can be used. The Belleville washer and adjustment screw configuration is shown in the drawings and described above. A different type of small leaf spring (e.g., a rectangular leaf spring) could also be used. Alternatively, an adjustment screw could be used to directly force apart the slot 18. The screw could be tightened until its end enters the slot 18 and then presses against the opposite side of the slot 18. If the screw is then tightened more, it would tend to force the slot 18 apart, thus increasing the effective diameter of the conductive pin 12. Wedges could be inserted into the slot 18, or removed from the slot 18, to vary the effective diameter of the pin 12.

A pin, key, or wedge could be used as a means of biasing the spring member 66, rather than an adjustment screw. An inverse conical washer also could be used in the slot 18, together with an adjustment screw. In this embodiment, the inverse conical washer could be inserted by slightly spreading the slot 18. By tightening the adjustment screw, the inverse conical washer would flatten, and allow the slot 18 to narrow. This configuration would allow the slot 18 to be widened or narrowed, thus increasing or decreasing the effective diameter of the conductive pin 12.

Figure 8:
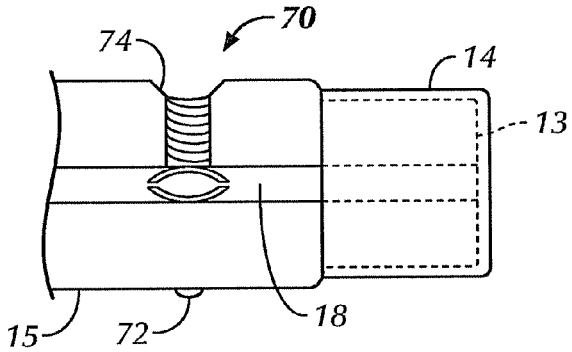
FIG. 8 (Prior Art)

FIG. 8 shows a prior art pin design. In this arrangement, the adjustment mechanism 70 is provided within the contact region 15 of the conductive pin 12. This positioning requires more force to separate the slot 18 because the adjustment mechanism is closer to the base of the slot 18. This configuration also may result in less precise adjustments because a very small adjustment of this type of mechanism will produce a larger variation in the effective diameter of the conductive pin 12. The present invention provides more precise adjustments and requires less force to obtain such adjustments.

The prior art configuration shown in FIG. 8 also leads to the specific disadvantages discussed in a prior section, above. The operation of the adjustment mechanism 70 can lead to a small dimple 72 on the opposite side of the pin 12. The enlarged, beveled port 74 can have exposed burs and can clog with debris during use. These problems have long existed in the field, as this design has been in wide use for many years. These and other problems are avoided by the present invention.

The present invention takes advantage of the use and positioning of the insulating safety cap 14. The cap 14 is not configured for removal in the field. It is, of course, possible to remove the cap 14 in the field by destroying it (e.g., by cutting or burning it off). But under normal operating conditions, the insulating safety cap 14 is not removed in the field. This fact means that by positioning the adjustment mechanism 20 under the safety cap 14, the present invention will greatly reduce the chances of field adjustments to the male connectors. This is advantageous because obtaining the proper fit between male and female connectors of this type is best done in a manufacturing, assembly, testing, or other non-field location where the conditions, including temperature, are controlled.

The present invention further includes the method of making and adjusting the single-pole, male connectors. The conductive pin 12, with its tip 13 and contact region 15 are made in a conventional manner. These parts are typically machined from copper and covered with aluminum or other material that is conductive, but somewhat more wear-resistant than copper. The slot 18 is cut or otherwise formed in a conventional manner, too. The contact region 15 has a slightly larger diameter than the tip 13. Even with the insulating safety cap 14 in place, the cap 14 has a slightly smaller diameter than the contact region.

The method of the present invention deviates from the prior art in the installation and use of the adjustment mechanism. Rather that installing the adjustment mechanism within the contact region 15, as shown in the prior art illustration of FIG. 8, the method of the present invention includes installing the adjustment mechanism in the tip 13, where the entire mechanism can be covered by the insulating safety cap 14.

A hole may be bored in one of the semi-cylindrical members and then threaded to received an adjustment screw. A spring member may then be inserted into the slot 18 in the tip 13. The adjustment screw exerts force on the spring member as the screw is loosened or tightened. Once the installation of the adjustment mechanism is complete, but before the insulating safety cap 14 is installed, the fit between the male and female is checked. The male may be tested with a diameter gage or using a standard female receptacle. If the fit is too loose, the adjustment mechanism is altered until the needed fit is achieved. The process of checking the diameter of the contact region and making needed adjustments is repeated until the required fit is obtained.

When all required adjustments have been made, the insulating safety cap 14 is positioned over the tip 13 of the pin 12. The safety cap 14 covers the adjustment mechanism. Because the safety cape 14 is not configured for field removal, this arrangement renders the adjustment mechanism inaccessible during normal operations. It is possible for one to remove the cap 14 in the field by destroying it, but that is not a normal operation. Once the required adjustments have been made and the insulating safety cap 14 is installed, the method of the present invention is complete.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A single-pole, male, electrical connector, comprising:

a. an electrically conductive pin having a contact region, a tip, and a slot extending along most of the contact region and to the tip, wherein the slot extends entirely through the pin whereby the pin is divided into two semi-cylindrical members;

b. an insulating safety cap positioned over the tip of the conductive pin; and, c. an adjustment mechanism positioned under the insulating safety cap and configured to vary the width of the slot and thus the effective diameter of the conductive pin.

2. The connector of claim 1, wherein the outside diameter of insulating safety cap is less than the outside diameter of the contact region of the conductive pin.

3. The connector of claim 1, wherein the insulating safety cap is permanently attached to the tip of the conductive pin.

4. The connector of claim 1, wherein the conductive pin and the insulating safety cap are rated for currents in excess of 1,000 amps.

5. The connector of claim 1, wherein the adjustment mechanism further comprises a spring member positioned within the slot.

6. The connector of claim 5, wherein the spring member is a Belleville spring.

7. The connector of claim 5, wherein the adjustment mechanism further comprises a means for biasing the spring member.

8. The connector of claim 5, wherein the adjustment mechanism further comprises an adjustment screw.

9. A method of making and adjusting a single-pole, male, electrical connector, comprising;

a. making a cylindrical, electrically conductive pin having a contact region and a tip, wherein the outside diameter of the tip is less than the outside diameter of the contact region;

b. cutting a slot in the conductive pin extending from the tip and through most of the contact region of the pin such that the pin is divided into two semi-cylindrical members;

c. installing an adjustment mechanism within the slot of the conductive pin and in the tip of the conductive pin;

d. determining whether the contact region of the conductive pin has a desired outside diameter;

e. if the contact region of the conductive pin does not have the desired outside diameter, varying the effective diameter of the conductive pin by adjusting the adjustment mechanism;

f. repeating steps d. and e. until the contact region of the conductive pin has the desired outside diameter; and, g. installing an insulating safety cap over the tip of the conductive pin such that the adjustment mechanism is rendered inaccessible during normal use.

10. The method of claim 9 wherein the insulating safety cap is permanently installed on the conductive pin.

11. A method of assembling a single-pole, male, electrical connector, comprising;

a. installing an adjustment mechanism near a tip of a conductive pin of the connector;

b. determining whether the conductive pin has a desired outside diameter;

c. if the conductive pin does not have the desired outside diameter, altering the effective diameter of the conductive pin using the adjustment mechanism;

d. repeating steps b. and c., if needed, until the conductive pin has the desired outside diameter; and, e. installing an insulating safety cap over the tip of the conductive pin such that the adjustment mechanism is rendered inaccessible during normal use.

12. The method of claim 11 wherein step a. further comprises installing a spring member within a slot in the conductive pin.

13. The method of claim 12 wherein step a. further comprises boring a hole in a first semi-cylindrical member of the conductive pin, threading the hole, and screwing an adjustment screw into the hole.

14. The method of claim 13, wherein the operation of the adjustment mechanism of step c. further comprises screwing or unscrewing the adjustment screw to increase or decrease the bias on the spring member and thus varying the width of the slot and the effective diameter of the conductive pin.

* * * * *